US009458567B2

(12) United States Patent
Sikorski

(10) Patent No.: US 9,458,567 B2
(45) Date of Patent: Oct. 4, 2016

(54) METHODS AND SYSTEMS FOR ADDING FILLER TO LATEX

(75) Inventor: Bonnie Sikorski, Norcross, GA (US)

(73) Assignee: SST FOAM, LLC, Norcross, GA (US)

( * ) Notice: Subject to any disclaimer, the term of this patent is extended or adjusted under 35 U.S.C. 154(b) by 643 days.

(21) Appl. No.: 12/359,348

(22) Filed: Jan. 26, 2009

(65) Prior Publication Data

US 2010/0189907 A1 Jul. 29, 2010

(51) Int. Cl.
*D06N 7/00* (2006.01)
*D06N 3/00* (2006.01)

(52) U.S. Cl.
CPC ..... *D06N 7/0073* (2013.01); *D06N 3/0056* (2013.01); *D06N 3/0061* (2013.01); *D06N 2203/02* (2013.01)

(58) Field of Classification Search
CPC .... D06N 3/0056; D06N 3/0061; D06N 7/00; D06N 7/0036; D06N 7/0073; D06N 2203/02
USPC ..... 427/427.4
See application file for complete search history.

(56) References Cited

U.S. PATENT DOCUMENTS 2,314,421 A * 3/1943 Peterson ..... 366/152.1
2,818,199 A * 12/1957 Morton et al. ..... 222/189.02
4,278,482 A 7/1981 Poteet et al.
4,888,134 A 12/1989 Kleitz et al.
5,330,576 A * 7/1994 Clauditz ..... 118/688
6,040,381 A 3/2000 Jennings et al.
6,216,389 B1 4/2001 Motz et al.
6,299,959 B1 10/2001 Squires et al.
6,767,932 B2 7/2004 Tolen et al.
6,988,524 B2 1/2006 Shaffer
2002/0026690 A1 3/2002 Moore et al.
2003/0170420 A1 9/2003 Higgins et al.
2006/0111475 A1* 5/2006 Mabry et al. ..... 523/318
2007/0207286 A1 9/2007 Craig et al.
2007/0275207 A1 11/2007 Higgins et al.
2007/0286982 A1 12/2007 Higgins et al.
2008/0050519 A1 2/2008 Hubbuch et al.
2008/0050520 A1 2/2008 Hubbuch et al.

* cited by examiner

*Primary Examiner* — Robert S Walters, Jr.

(74) *Attorney, Agent, or Firm* — Sutherland Asbill & Brennan LLP

(57) ABSTRACT

A latex mixing and application system for use with a textile product. The latex mixing and application system may include a latex source with a liquid latex therein, a filler source with a filler therein, a mixer in communication with the latex source and the filler source to mix the liquid latex and the filler to form a latex/filler mix, and an applicator in communication with the mixer to apply the latex/filler mix to the textile product.

11 Claims, 1 Drawing Sheet

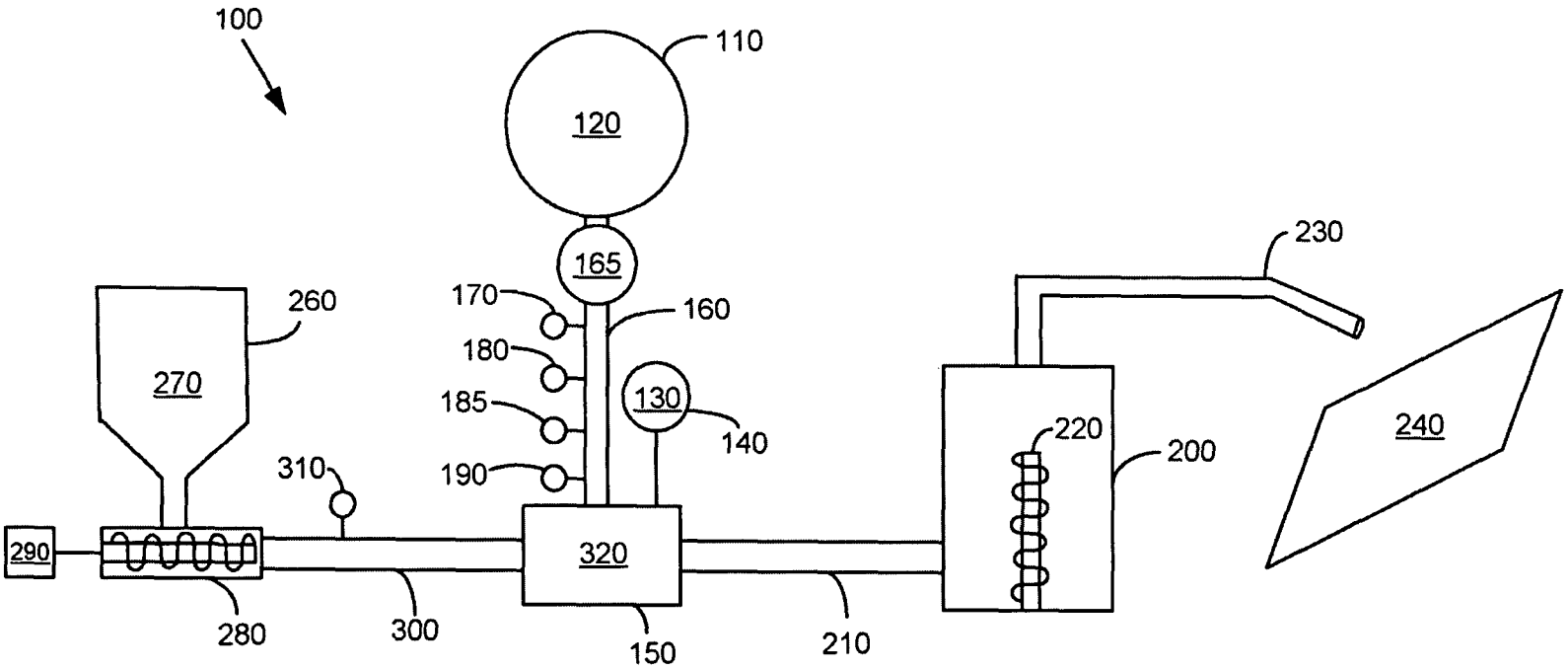
100
110
120
165
160
170
180
185
190
130
140
320
150
210
200
220
230
240
300
310
260
270
280
290

METHODS AND SYSTEMS FOR ADDING FILLER TO LATEX

TECHNICAL FIELD

The present application relates generally to carpets and other types of textiles and more particularly relates to methods and systems for adding filler to a stream of liquid latex used to create a carpet backing or a similar type of surface just prior to application.

BACKGROUND OF THE INVENTION

It is common to apply latex to the back of carpets, rugs, and other types of textile products. The latex backing provides stability, washability, and a non-skid surface. The latex generally is pumped and applied to the carpeting as a liquid foam stream. The foam is then heated and cured to form the backing.

The latex is generally a combination of natural and synthetic rubber as well as activating agents and other types of materials. As the cost of virgin latex has increased, it is becoming more common to add various types of fillers and other types of solids to the liquid latex. The use of fillers and other types of solids has the advantage of reducing the overall cost of the rubber backing. The addition of the fillers also permits the use of less water in the liquid latex formulation. The use of less water in the formulation may promote faster drying and/or the use of less energy in the curing process.

Although the use of fillers and other types of solids may be common, the fillers and/or solids are generally mixed in with the liquid latex formulation well prior to the actual application of the liquid latex formulation to the carpeting or other types of textile products. In other words, the liquid latex solution generally comes premixed with the fillers. The latex applicator thus does not have the opportunity to mix in whatever types of fillers or solids may be on hand and/or may be less expensive.

There is thus a desire therefore for improved methods and systems for adding fillers and other types of solids to a liquid latex formulation. The methods and systems should allow the applicator to mix in whatever types of fillers or solids may be available while providing a high quality carpet backing.

SUMMARY OF THE INVENTION

The present application thus provides a latex mixing and application system for use with a textile product. The latex mixing and application system may include a latex source with a liquid latex therein, a filler source with a filler therein, a mixer in communication with the latex source and the filler source to mix the liquid latex and the filler to form a latex/filler mix, and an applicator in communication with the mixer to apply the latex/filler mix to the textile product.

The latex mixing and application system further may include a holding tank in communication with the mixer and the applicator. The holding tank may include an agitator therein. The mixer may be a static mixer or a blender. The applicator may include an extended flexible tube. The filler source may include a variable speed motor and a screw drive or a pneumatic blower. The filler may include a rubber crumb, a rubber powder, or a ground cork.

The present application further provides a method of applying a latex/filler mix to a textile product. The method may include placing a latex source with a liquid latex therein in communication with a filler source with a filler therein, mixing a flow of the liquid latex with a flow of the filler in a mixer to form the latex/filler mix, and applying the latex/filler mix with an applicator in communication with the mixer.

The method further may include placing a holding tank in communication with the mixer and the applicator. The step of mixing a flow of the liquid latex with a flow of the filler may include driving the filler from the filler source to the mixer. The step of driving the filler may include varying a flow rate of the filler. The step of mixing a flow of the liquid latex with a flow of the filler may include mixing a flow of a rubber crumb or a rubber powder. The step of mixing a flow of the liquid latex with a flow of the filler may include mixing a flow of a ground cork. The method further may include varying the filler used with the filler source.

The present application further provides for a latex mixing and application system for use with a carpet or rug. The system may include a latex source with a liquid latex therein, a filler source with a rubber filler therein, a mixer in communication with the latex source and the filler source to mix the liquid latex and the rubber filler to form a latex/filler mix, a holding tank in communication with the mixer, and an applicator in communication with the holding tank to apply the latex/filler mix to the carpet or rug. The holding tank may include an agitator therein. The filler source may include a variable speed motor. The filler source also may include a screw drive or a pneumatic blower.

These and other features and improvements of the present application will become apparent to one of ordinary skill in the art upon review of the following detailed description when taken in conjunction with the several drawings and the appended claims.

BRIEF DESCRIPTION OF THE DRAWINGS

FIG. 1 is a schematic view of a latex mixing and application system as is described herein.

DETAILED DESCRIPTION

Referring now to the drawing, in which like numerals refer to like elements throughout the several views, FIG. 1 shows a latex mixing and application system 100 as is described herein. The latex mixing and application system 100 includes a latex source 110. The latex source 110 may be any type of storage or holding tank with any desired size or shape. The latex source 110 may include any type of a liquid latex 120 therein. The liquid latex 120 may be natural, synthetic, and/or blends thereof. Likewise, the liquid latex 120 may be virgin, recycled, and/or blends thereof. The liquid latex 120 may be mixed with other components such as accelerators, gelling agents, soaps, activating agents, surfactant, and other types of additives 130. The additives 130 may be positioned within one or more additive sources 140. The additive sources 140 also may be any type of storage or holding tank with any desired size or shape.

The liquid latex 120 and the additives 130 may be mixed within a mixer 150. The mixer 150 may be a static mixer, a blender, other types of mixing devices, or simply a line in which the various components may be transported. The latex source 110 may be in communication with the mixer 150 via a latex source line 160. A pump 165 may be positioned between the latex source 110 and the mixer 150. The pump 165 may be any type of conventional pumping device. The additive sources 140 also may use a similar pump 165.

Depending upon the nature of the latex source 110, the latex source line 160 may include a pressure regulator 170. The pressure regulator 170 may be of conventional design. The latex 120 may be pumped from the latex source 110 to the mixer 150 under a substantially constant pressure. The latex source line 160 also may include a mass flow meter 180 and a pump control system 185. The mass flow meter 180 and the pump control system 185 may be any type of conventional devices to determine and control the flow rate of the liquid latex 120 through the latex source line 160 and the pump 165. The latex source line 160 also may include a pressure sensor 190. The pressure sensor 190 may be of conventional design. The pressure sensor 190 provides overload safety protection while the pressure regulator 170 maintains a constant pressure therein.

The latex mixing and application system 100 also may include a holding tank 200. The holding tank 200 may be in communication with the mixer 150 via a mixer line 210. The holding tank 200 may include an agitator 220 therein. The agitator 220 may be a screw type device or any type of device that maintains the liquid latex 120 in a substantially flowable state. The holding tank 200 may have any size or shape. The use of the holding tank 200 may be optional.

The latex mixing and application system 100 also may include an applicator 230. The applicator 230 may include an extended flexible tube and may include a nozzle or other type of spraying mechanism. The applicator 230 may be used with a traversing trolley (not shown) or similar devices so as to apply the liquid latex 120 to the back of a carpet 240 or other type of a textile product. The applicator 230 may have any desired shape or length. The applicator 230 may be in communication with the holding tank 200 or the mixer 150 via a pump or a similar type of device or the pump 165 upstream of the holding tank 200 may maintain an adequate pressure.

The latex mixing and application system 100 also includes a filler tank 260. The filler tank 260 may have any size or shape. The filler tank 260 may include any number of different types of solids or filler materials 270 therein. For example, the filler material 270 may be a rubber crumb or a rubber powder. The rubber crumb may be made from ground up used automobile tires and the like. Likewise, a ground cork material also may be used. The ground cork also may be a recycled material. Other types of filler material 270 may include other types of ground rubber material, calcium carbonate, other types of ground recycled waste materials, etc.

The filler tank 260 may include a screw drive 280 driven by a drive motor 290. Other types of drive mechanisms may be used to force the filler material 270 out of the filler tank 260. The drive motor 290 may be a conventional variable speed motor or similar types of devices. The drive motor 290 may vary the speed of the screw drive 280 to vary the amount of the filler material 290 that is advanced to the mixer 150 so as to provide a predetermined ratio of latex 120 to filler 270. The filler tank 260 may be in communication with the mixer 150 via a holding tank line 300. A pressure sensor 310 may be positioned on the holding tank line 300. Alternatively, the filler tank 260 also may include a pneumatic blower system associated with the drive motor 290. The drive motor 290 may vary the rate of air flow so as to vary the amount of material that is advanced to the mixer 150.

The liquid latex 120 and the filler material 270 may mix in the mixer 150 so as to form a latex/filler mix 320 in a predetermined ratio. The latex/filler mix 320 may advance to the holding tank 200 and then may be applied to the carpet 240 or other type of textile via the applicator 230 in a conventional fashion. The latex/filler mix 320 may then be dried and cured.

The latex mixing and application system 100 thus permits the mixing of the liquid latex 120 with the filler material 270 immediately prior to application to the carpet 240. The filler tank 260 permits the use of different types of filler materials 270 by the applicator. Moreover, the applicator of the latex mixing and application system 100 also may vary the amount of the filler material 270 used in a particular application as well as the type of the filler material 270. The latex mixing and application system 100 gives the applicator considerable flexibility in the composition of the final product. The latex mixing and application system 100 also permits the applicator to use locally available recyclable materials as the filler materials 270. As such, the latex mixing and application system 100 provides the user with greater flexibility and cost control as compared to premixed formulations.

The use of the rubber crumb filler may improve the gelling process in going from a liquid to a semi-solid. This would allow faster processing and improved production speed. The filler also would allow the use of less water and improve the curing time. Less curing time means more production and less energy demand. The filler also may allow the latex to be tougher so as to improve wearability, life, and quality of the product.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

I claim:

1. A latex mixing and application system for use with a textile product, comprising:

a latex source tank with a premixed liquid latex therein;

wherein the premixed liquid latex comprises natural and synthetic rubber;

a local filler tank with only a rubber powder filler therein;

a mixer in communication with the latex source tank and the local filler tank, the mixer configured to mix the premixed liquid latex and the filler to form a latex/filler mix; and an applicator in communication with the mixer, the applicator configured to apply the latex/filler mix to the textile product;

wherein the mixer mixes the premixed liquid latex and the filler prior to the applicator.

2. The latex mixing and application system of claim 1, further comprising a holding tank in communication with the mixer and the applicator.

3. The latex mixing and application system of claim 2, wherein the holding tank comprises an agitator therein.

4. The latex mixing and application system of claim 1, wherein the mixer comprises a static mixer or a blender.

5. The latex mixing and application system of claim 1, wherein the applicator comprises an extended flexible tube.

6. The latex mixing and application system of claim 1, wherein the filler tank comprises a variable speed motor.

7. The latex mixing and application system of claim 1, wherein the filler tank comprises a screw drive or a pneumatic blower.

8. A latex mixing and application system for use with a carpet or rug, comprising:

a latex source tank with a premixed liquid latex therein;

wherein the premixed liquid latex comprises natural and synthetic rubber;

a local filler tank with only a rubber powder filler therein;

a mixer in communication with the latex source tank and the filler tank, the mixer configured to mix the premixed liquid latex and the rubber powder filler to form a latex/filler mix;

a holding tank in communication with the mixer; and an applicator in communication with the holding tank, the applicator configured to apply the latex/filler mix to the carpet or rug;

wherein the mixer mixes the premixed liquid latex and the rubber powder filler prior to the applicator.

9. The latex mixing and application system of claim 8, wherein the holding tank comprises an agitator therein.

10. The latex mixing and application system of claim 8, wherein the filler tank comprises a variable speed motor.

11. The latex mixing and application system of claim 8, wherein the filler tank comprises a screw drive or a pneumatic blower.

* * * * *